United States Patent [19]

Street et al.

[11] 4,245,684

[45] Jan. 20, 1981

[54] GOLF BAG SYSTEM

[76] Inventors: Glynn E. Street, 155 Funke Rd., Glen Burnie, Md. 21061; Arthur R. Crandell, 7215-E Eubanks Loop, Ft. Meade, Md. 20755

[21] Appl. No.: 100,023

[22] Filed: Dec. 3, 1979

[51] Int. Cl.[3] ..... A63B 55/02

[52] U.S. Cl. ..... 150/1.5 B

[58] Field of Search ..... 150/1.5 R, 1.5 B, 1.5 C

[56] References Cited

U.S. PATENT DOCUMENTS

| | | | |
|---|---|---|---|
| 1,829,093 | 10/1931 | Hollins | 150/1.5 C |
| 1,918,447 | 7/1933 | Blatz | 150/1.5 R |
| 1,955,463 | 4/1934 | Lathrop | 150/1.5 B |
| 1,956,008 | 4/1934 | Deibel | 150/1.5 R |
| 2,950,748 | 8/1960 | Olinghouse | 150/1.5 R |
| 3,708,004 | 1/1973 | Seibold | 150/1.5 B |

*Primary Examiner*—Donald F. Norton

*Attorney, Agent, or Firm*—Morton J. Rosenberg

[57] ABSTRACT

A golf bag system (10) which is utilized for containing and classifying various objects used by a player during the playing of a golf game. The golf bag system (10) includes a longitudinally extended outer housing (24) generally formed in a cylindrical shape and a second internal secondary housing (38), which extends substantially central to the first housing (24). The first housing (24) includes a first housing chamber (28) which is substantially annular in contour for insertion thereof in predetermined locations objects such as golf clubs (16). The second housing (38) includes an upper and lower compartment (46) and (44), divided by a partition member (42). The upper compartment (44) includes golf ball dispensing mechanism (50) to allow easy egress of golf balls (20) contained therein. Additionally, system (10) includes a housing cover (52) which is rotatably actuatable with respect to both the first housing (24) and the second housing (38). The housing cover (52) includes a first housing door member (60) to allow access to the golf clubs (16) and a second housing door member (66) to allow access to the golf balls (20).

10 Claims, 7 Drawing Figures

FIG. 1
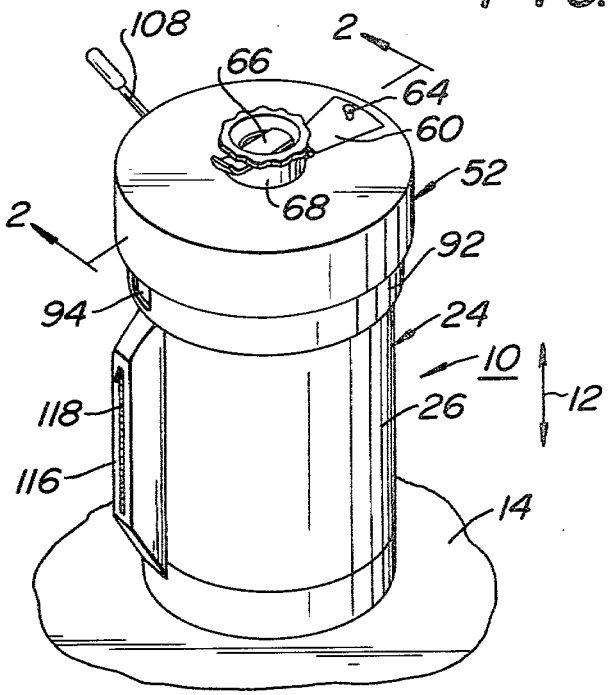
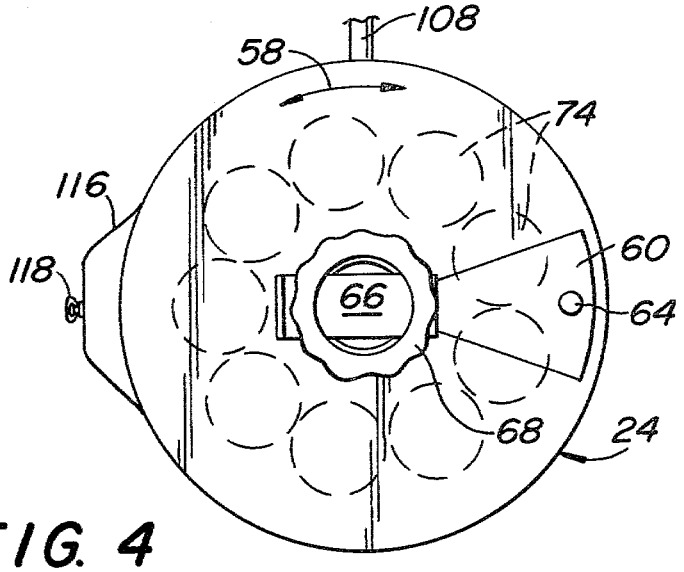
FIG. 4

GOLF BAG SYSTEM

BACKGROUND OF THE INVENTION

1. Field of the Invention

This invention pertains to carrier systems in general. In particular, this invention relates to golf bag systems. More in particular, this invention relates to golf bag systems which are used for classifying various objects contained therein. More in particular, this invention relates to golf bag systems which provide for a plurality of compartment areas within which specific items of use during the playing of a golf game are contained. Still further, this invention pertains to an improved golf bag system which includes a rotatable cover member having a plurality of door access members to provide access into particular portions of the golf bag system. Still further, this invention relates to an improved golf bag system which has a golf ball dispensing mechanism contained therein which may be accessed through a cover member. Still further, this invention pertains to an improved golf bag system which may be used as a golf caddy through retractable wheels mounted on a lower base surface. Still further, this invention pertains to an improved golf bag system which provides a total enclosure for items contained therein to insulate such from the external environment.

2. Prior Art

Golf bag carrier systems are well-known in the art. The best prior art known to the inventors include U.S. Pat. Nos.: 4,111,248; 3,941,398; 3,172,681; 3,848,737; 3,996,983; 1,840,663; 3,503,518; 1,918,447; 2,520,226; 715,759; and, 2,003,733. Although various elements of golf club carrying systems are shown in the previously described U.S. Patents, none of these references provides for unique types of door opening mechanism mounted on a rotatable cover enclosing the golf bag carrying system. In the reference U.S. Pat. No. 4,111,248, such includes a club carrier having a golf club holder which rotates about an axis. However, such does not provide for the rotatable type covering system as is shown in the subject invention.

Other prior art Patents such as No. 3,941,398, although being directed to golf holding systems, are generally rectangular in contour which obviates the possibility of a rotatable cover member to allow alignment of a door member contained therein for access to a predetermined location for a golf club within a housing.

Other prior art golf systems such as that shown in U.S. Pat. No. 3,848,737 do provide for a cover for a particular golf set. However, such like prior art systems although providing an area or volume for storage, do not provide for the spring-loaded type of golf ball dispensing mechanisms, and further do not provide for the pair of door openings within the golf club set cover for access to both the golf balls and to the golf clubs.

SUMMARY OF THE INVENTION

A golf bag system which includes a longitudinally extended first housing for containing a predetermined number of golf clubs. The first housing has at least one internal compartment located adjacent a sidewall thereof. A longitudinally extended second housing is positionally located central said first housing and fixedly mounted thereto. A housing cover is rotatably mounted on the first and second housing for providing internal access to both of the first and second housings. A rotatable strap member is slidingly mounted on the first housing sidewall for alignment thereof with the internal compartment. Further, there is provided a retractable wheel mechanism which is rotationally coupled to a base wall of the first housing for providing rolling displacement of the golf bag system with respect to some external surface.

BRIEF DESCRIPTION OF THE DRAWINGS

FIG. 1 is a perspective view of the golf bag system;

FIG. 4 is a top view of the golf bag system in section and taken along the section line 4—4 of FIG. 2;

DESCRIPTION OF THE PREFERRED EMBODIMENTS

Figures 2, 3:
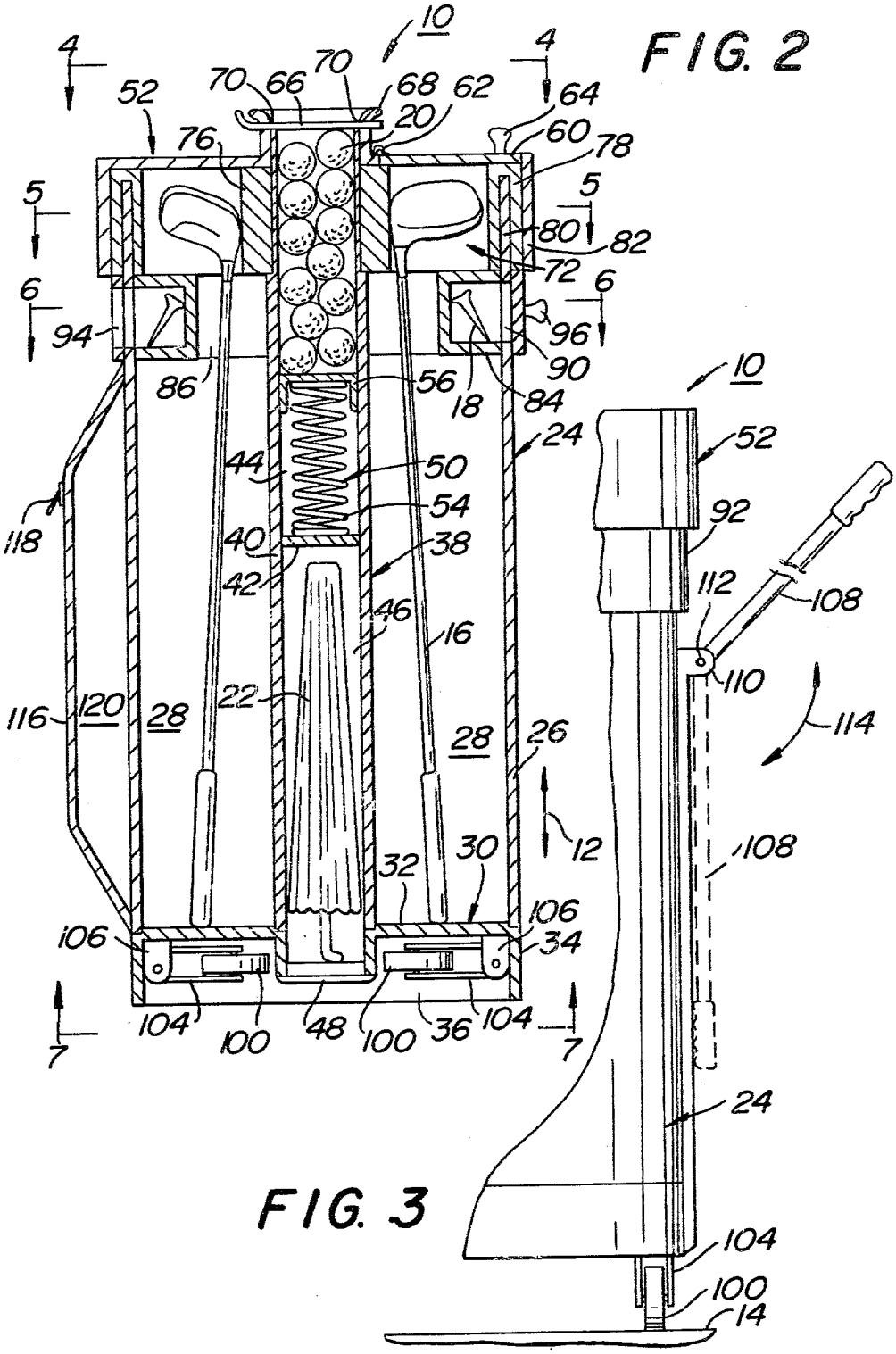
FIG. 2 is a cross-sectional view of the golf bag system taken along the section line 2—2 of FIG. 1 and showing the internal compartments of the golf bag system.
FIG. 3 is a partially cut-away elevational view of the golf bag system when positionally placed in rolling displacement with respect to an external surface.

Referring now to FIGS. 1 and 2, there is shown golf bag system 10 for containing golf clubs 16, golf tees 18, golf balls 20, and associated golfing equipment such as umbrellas 22. Containment of other articles needed by a golfer may be provided in various chambers and areas of insert, as will be described in following paragraphs. In overall concept, golf bag system 10 is utilized to contain various golfing equipment needed by a golfer when playing the game. System 10 is directed to an overall enclosure housing system which protects the objects used by the golfer from the external environment. Further, system 10 will be shown to have a dual purpose, notably that of a golf bag, as well as a golf caddy system. In this manner, the golfer may classify the objects to be used in the game and maintain such in an insulated fashion from the external environment.

Referring now to FIGS. 1–3, it is seen that golf bag system 10 includes first or outer housing 24 extended in longitudinal direction 12 for containing golf clubs 20. Housing 24 includes longitudinally extended sidewalls 26 formed in a tubular manner to provide first housing chamber 28 for containment of golf clubs 16.

First housing 24 includes base section or portion 30 being formed in a cup-shaped contour, and including floor member 32 and base sidewalls 34. Base floor 32 may be formed in one-piece formation with base sidewalls 34 to provide base cavity 36, as is shown in FIG. 2. Base sidewalls 34 are coupled to first housing sidewalls 26 in fixed relation through adhesive bonding, bolting, or some like technique not important to the inventive concept. The important consideration being that base section 30 forms base recess 36 for purposes and objectives to be discussed in following paragraphs. First or outer housing 24 including sidewalls 26, base floor 32, and base sidewalls 34 may be formed of a rigid material such as plastic, or some like composition, which would be impervious to external environmental considerations in order to protect objects contained therein.

System 10 further includes longitudinally extended second housing 38, which is positionally located substantially central first or outer housing 24. Second housing 38 is generally tubular in nature and includes second housing sidewalls 40, as is seen in FIG. 2. External sidewalls 40 of second housing 38 may be formed of a similar composition as that provided for first housing 24.

Second housing 38 includes partition member 42 located approximately central the longitudinal extension of second housing 38. Partition member 42 divides second housing 38 into second housing upper compartment 44 and second housing lower compartment 46. Second housing lower compartment 46 is provided in order to allow the user to store or otherwise contain an elongated member such as umbrella 22, as is depicted in FIG. 2. Lower compartment 46 is closed by lower compartment cover 48, which may be force-fit to provide a covering for lower compartment 46. Cap or cover 48 is frictionally inserted against the internal surfaces of second housing sidewalls 40 to provide a fixed constrainment for objects 22 contained within lower compartment 46. It is to be understood that cover or cap member 48 may be threadedly secured, or mounted in some other type of releasable coupling to second housing 38, the manner of which is not important to the inventive concept as is herein described.

Housing upper compartment 44 includes golf ball dispensing mechanism 50 mounted within the upper chamber or compartment 44 for biasing a plurality of golf balls 20 against a portion of housing cover 52, as will be described in following paragraphs. Golf ball dispensing mechanism 50 includes spring member 54, which is sandwiched between partition member 42 and platform 56. Platform member 56 is slidably displaceable with respect to the internal surfaces of second housing sidewalls 40 to allow displaceable movement of platform member 56 in longitudinal direction 12. Golf balls 20 are thus sandwiched between platform 56 and a portion of housing cover 52. Spring member 54 is compressively displaceable in longitudinal direction 12 and is biased against partition member 42 when a plurality of golf balls 20 are inserted into upper compartment 44.

Housing cover 52, as shown in FIGS. 1, 2 and 4, is insertable over an upper section of first or outer housing 24. Additionally, housing cover 52 may be rotationally activated in arcuate direction 58, as is shown in FIG. 4. Thus, housing cover 52 is rotatable with respect to sidewalls 26 of first housing 24 for purposes and objectives to be described in following paragraphs. Housing cover 52 is generally cup-shaped in contour and includes first housing door member 60, which is mounted through hinge 62 to an upper surface of housing cover 52. Door member 60 further includes door handle 64, which is used for rotationally activating or displacing door member 60 in rotational fashion about hinge 62, as well as to provide a hand-hold for the user in the rotation of the entire housing cover 52 about sidewalls 26 of first or outer housing 24. In this manner, the user may rotationally activate housing cover 52 to a predetermined segment for providing access to one of golf clubs 16 of particular interest.

Housing cover 52 further includes second housing door member 66 which is slidingly displaceable with respect to housing cover 52 for providing access to second housing upper compartment 44. Second housing door member 66 may be slidable within a pair of slot sections formed in extended housing member 68 to provide access to second housing upper compartment 44. As can be seen, when second housing door member 66 is displaced in a transverse direction with respect to longitudinal direction 12, golf balls 20 contained within compartment 44 are biased in an upward direction through actuation of golf ball dispensing mechanism 50. In this manner, the user may remove one or more golf balls 20 from upper compartment 44 for use. Subsequent to this action, the user may slide second housing door member 66 into cooperation with slots 70 to block or otherwise intercept the upward path of golf balls 20 to contain such within upper compartment 44.

Figure 5:
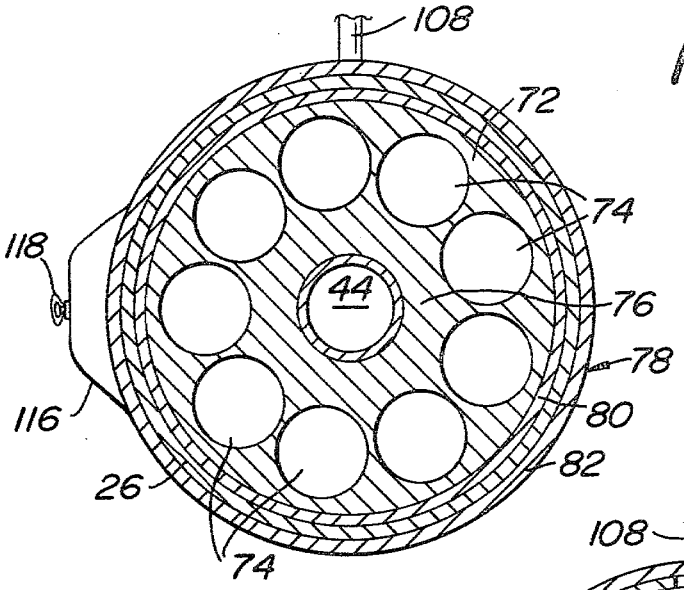
FIG. 5 is a sectional view of the golf bag system taken along the section line 5—5 of FIG. 2.
Figure 6:
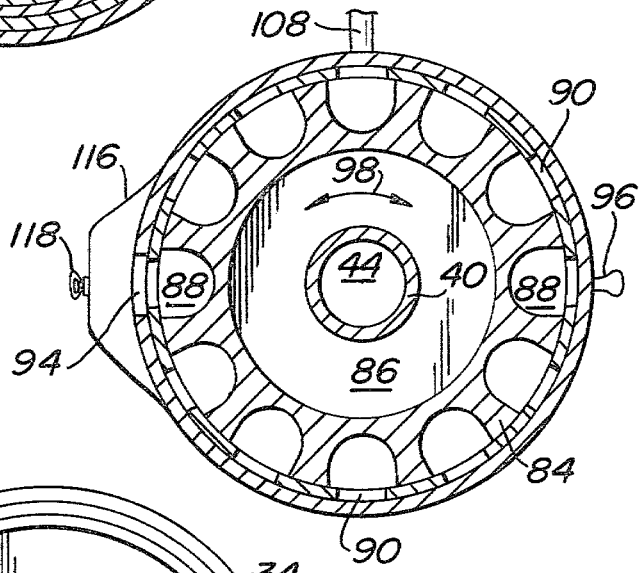
FIG. 6 is a sectional view of the golf bag system taken along the section line 6—6 of FIG. 2; and, FIG. 7 is a bottom view of the golf bag system.

Referring to FIGS. 2, 5 and 6, system 10 further includes golf club alignment member 72 which is generally cylindrical in contour, having a plurality of golf club openings 74 passing therethrough.

Golf club alignment member 72 in envelope contour is generally annular in concept, having discrete vertically directed openings 74 for insert of golf clubs 16, as is seen in FIG. 2. Alignment member 72 includes inner wall sectin 76 and U-shaped outer wall member 78. U-shaped outer wall member 78 includes first and second longitudinally extended legs 80 and 82, which cooperatively fit or slide over the upper portion of first housing sidewall 26. In this manner, alignment member 72 is seen to matingly engage and cooperatively fit over housing sidewalls 26. Alignment member 72 may then be adhesively bonded, or otherwise fixedly secured, to sidewalls 26 in any known standard manner. In this way, the shafts of golf clubs 16 may be inserted through golf club openings 74 to provide a particular compartment area or volume within which a predetermined golf club 16 may be accessed by the user.

Referring now to FIGS. 2 and 6, it is seen that first or outer housing 24 further includes lower disc member 84. Lower disc member 84 is generally disc-like in contour, havng a central opening 86 through which golf clubs 16 may be passed. Additionally, lower disc member 84 includes a plurality of compartments 88 mounted adjacent housing sidewalls 26. Compartments 88 are provided to contain various objects such as golf tees 18 as is shown in FIG. 2.

First housing sidewalls 26 include sidewall openings 90 which are alignable with compartment 88, as is shown in FIG. 6. Additionally, external to sidewalls 26 there is provided rotatable strap member 92 which is slidingly mounted on first housing sidewalls 26 for alignment of strap member opening 94 with both sidewall openings 90 and compartment 88. Thus, when strap member openings 94 are aligned with a respective sidewall opening 90, the user may insert his/her fingers and remove objects contained therein, such as golf tees 18. Rotation of strap member 92 is facilitated by use of strap knob 96 which allows rotational actuation of strap member 92 in a reversible arcuate direction, shown by arcuate arrow 98 in FIG. 6. Lower disc member 84 may be fixedly secured to an inner surface of sidewalls 26 through adhesive bonding, bolt securement, or some like technique not important to the inventive concept as is herein described.

Figure 7:
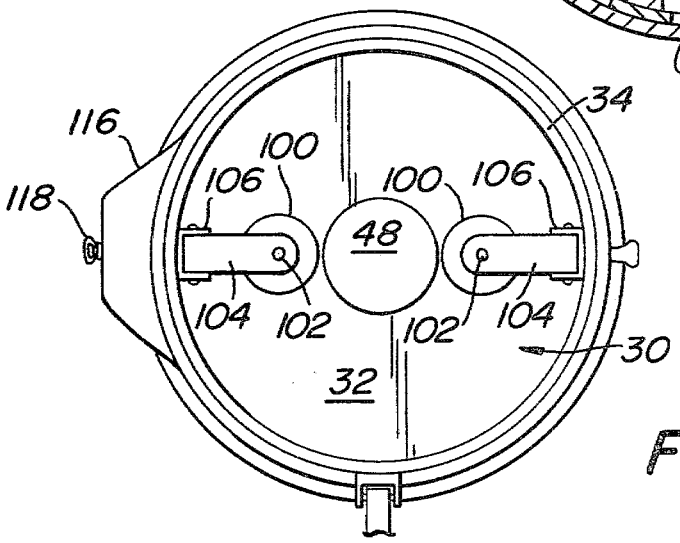

Referring now to FIGS. 2, 3 and 7, there is shown retractable wheels 100 rotationally coupled to base floor 32 of first or outer housing 24 for providing rolling displacement of golf bag system 10 with respect to external surface 14. Wheels 100 are rotationally displaceable about pivot 102 which is mounted to first wheel bracket 104. First wheel bracket 104 is generally U-shaped in contour having a pair of leg members extending on opposing sides of wheels 100 and being rotationally mounted at pivot 102.

First wheel bracket 104 is rotationally mounted to second wheel bracket 106 for reversible rotation of first wheel bracket 104 internal to base recess 36, as well as external to base recess 36 for rolling contact with external surface 14. Second wheel bracket 106 is mounted as is shown in FIG. 2, to base floor 32 through bolting, screws, or some like fixed coupling not important to the inventive concept as is herein described. In this manner, wheels 100 may be folded or rotated internal to base recess 36, as is shown in FIG. 2, when the user wishes system 10 to be maintained stationary on external surface 14. Alternatively, the user may rotate wheels 100 to a configuration shown in FIG. 3, wherein wheels 100 are used for rolling displacement on external surface 14.

Referring now to FIG. 3, there is shown handle member 108 which is rotatably actuatable about handle bracket 110 and handle pivot 112. As can be seen, handle member 108 may be arcuately directed or displaced in the direction of arcuate displacement arrow 114 to provide a hand-hold for the user during transport of system 10, or to be placed against sidewalls 26 of first or outer housing 24, as is shown in phantom line of FIG. 3. Additionally, handle member 108 may be telescoping in nature if so desired, however, such is not directed to the inventive concept as is herein described. Handle bracket 110 is mounted to sidewalls 26 through either bolting, screws, or some like fixed fastening technique.

Referring now to FIGS. 1 and 2, there is shown third housing 116 which is fixedly secured to first housing sidewalls 26. Third housing 116 forms third housing compartment 120 for additional space within which objects may be inserted. Further, third housing 116 includes closure member or mechanism 118 which, as is shown in the Drawings, may be a zipper element.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended Claims.

What is claimed is:

1. A golf bag system, comprising:

(a) a longitudinally extended first housing for containing a predetermined number of golf clubs; said first housing having at least one internal compartment adjacent a sidewall thereof;

(b) a longitudinally extended second housing positionally located central said first housing;

(c) housing cover means rotatably mountable on said first and second housings for providing internal access to said first and second housings;

(d) a rotatable strap member slidingly mounted on said first housing sidewall for alignment thereof with said internal compartment; and, (e) retractable wheel means rotationally coupled to a base wall of said first housing for providing rolling displacement of said golf bag system with respect to an external surface.

2. The golf bag system as recited in claim 1 where said second housing includes a second housing partition member, said second housing partition member for dividing said second housing into an upper compartment and a lower compartment.

3. The golf bag system as recited in claim 2 including golf ball dispensing means within said upper compartment of said second housing for biasing a plurality of golf balls against said housing cover means.

4. The golf bag system as recited in claim 3 where said golf ball dispensing means includes a spring member compressively displaceable in said longitudinal direction, said spring member being biased against said partition member when said golf balls are inserted into said upper compartment.

5. The golf bag system as recited in claim 1 where said housing cover means includes a first housing door member hingedly mounted to an upper surface of said first housing cover means for providing access to one of said golf clubs when said first housing door member is longitudinally aligned with respect to said golf club.

6. The golf bag system as recited in claim 5 where said housing cover means includes a second housing door member slidingly displaceable with respect to said housing cover means for providing access to said second housing.

7. The golf bag system as recited in claim 1 where said first housing includes a storage member secured to said sidewall of said first housing, said storage member being U-shaped in contour forming said internal compartment.

8. The golf bag system as recited in claim 7, including handle means rotationally coupled to said first housing for providing a hand-hold for said golf bag system when said retractable wheel means are in rolling operative contact with said external surface.

9. The golf bag system as recited in claim 1 where said retractable wheel means includes wheel hinge means for (1) rotating said wheel means to a first position above a lower end of said first housing to maintain said wheel means out of contact with said external surface, and, (2) rotating said wheel means to a second position below said lower end of said first housing to positionally locate said wheel means in contact with said external surface.

10. The golf bag system as recited in claim 1 including a third housing secured to an outer surface of said first housing, said third housing for providing a third housing compartment for storage of objects therein.

* * * * *